US005410823A

United States Patent [19]

Iyoob

[11] Patent Number: 5,410,823

[45] Date of Patent: May 2, 1995

[54] REPLACEABLE GOLF CLEAT

[76] Inventor: Simon J. Iyoob, 8605 Golf Ridge Dr., Charlotte, N.C. 28277

[21] Appl. No.: 187,095

[22] Filed: Jan. 26, 1994

[51] Int. Cl.[6] ..... A43C 15/00

[52] U.S. Cl. ..... 36/127; 36/134; 36/670

[58] Field of Search ..... 36/127, 128, 134, 135, 36/7.5, 59 R, 61, 62, 64, 66, 67 R, 67 D; 12/142 P, 142 Q

[56] References Cited

U.S. PATENT DOCUMENTS

| | | | |
|---|---|---|---|
| 2,722,062 | 11/1955 | Phillips | 36/127 |
| 3,020,654 | 2/1962 | McCann | 36/7.5 |
| 3,035,357 | 5/1962 | Valenti | 12/142 Q |
| 3,331,148 | 7/1967 | Hollister | 36/67 |
| 3,423,855 | 1/1969 | Kosono | 36/67 |
| 3,559,310 | 2/1971 | Kiela | 36/134 |
| 3,638,337 | 2/1972 | Dollar, Jr. | 36/67 R |
| 3,964,180 | 6/1976 | Cortese | 36/135 |
| 4,145,055 | 3/1979 | O'Brien | 36/135 |
| 4,240,215 | 12/1980 | Broussard | 36/67 |
| 4,445,288 | 5/1984 | Frör | 36/134 |
| 4,644,672 | 2/1987 | Dassler | 36/134 |
| 4,723,366 | 2/1988 | Hagger | 36/134 |
| 4,783,913 | 11/1988 | Aoyama | 36/670 |
| 4,922,636 | 5/1990 | Chen | 36/134 |
| 5,255,453 | 10/1993 | Weiss | 36/67 D |

*Primary Examiner*—Steven N. Meyers
*Attorney, Agent, or Firm*—Ralph H. Dougherty

[57] ABSTRACT

A replacement cleat or spike structure for attachment to the outer surface of a worn cleat or spike depending from the sole of a shoe, having a generally hollow, conical spike member attached at its base to a circular, dish-shaped flange. The hollow portion of the spike member is of a sufficient dimension to receive the nub of a worn spike attached to the sole of a golf shoe. The spike structure is placed onto the nub and flange of the worn spike and is held in place by epoxy or other suitable adhesive means.

21 Claims, 1 Drawing Sheet

Fig. 1
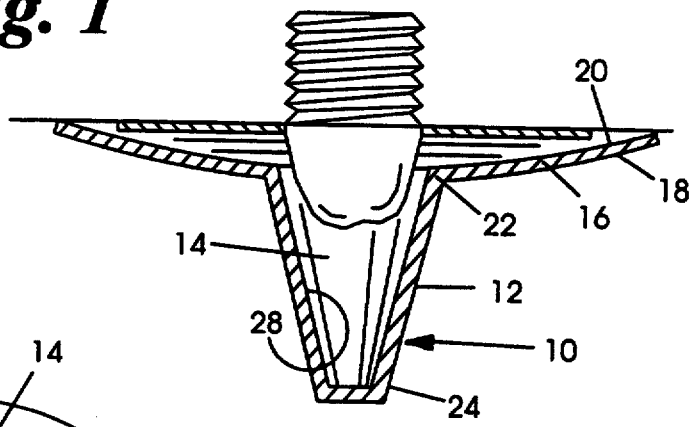
Fig. 2
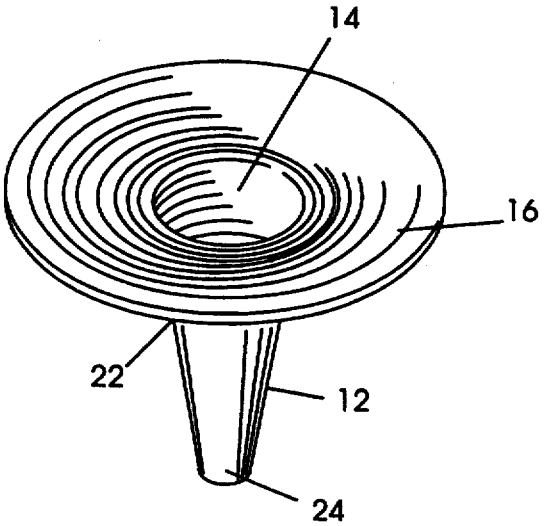
Fig. 3
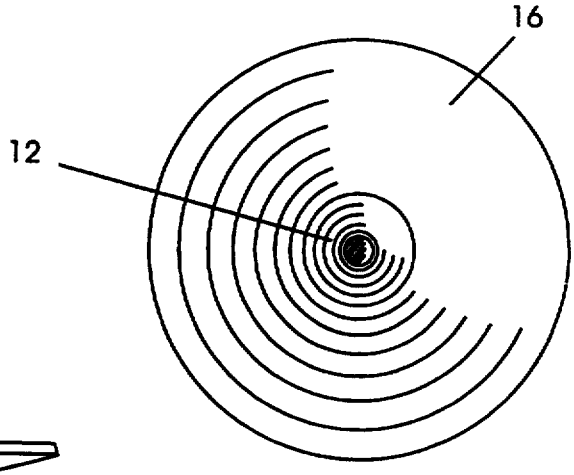
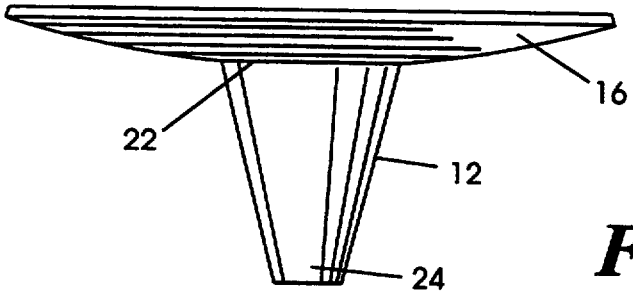
Fig. 4

REPLACEABLE GOLF CLEAT

FIELD OF THE INVENTION

The present invention relates to a cleat or spike for attachment to the sole of a sports shoe, and more particularly, to a replacement spike for attachment directly to the nub of an old, worn spike attached to the sole of a golf shoe.

BACKGROUND OF THE INVENTION

The game of golf is a very popular sport and requires special equipment to enable players to maximize their abilities. Special shoes for playing golf having conically shaped spikes attached generally perpendicularly to the outside surface of the sole are universally known. When such golf shoes are worn, these spikes engage and penetrate the ground and provide stability for the player when swinging a golf club. The spikes provide stability by preventing sliding, twisting, or other shifting of the player's feet during a golf swing. Such stability is necessary to provide balance to the player, which is essential for a proper golf swing. Over time, these spikes become worn and lose their ability to penetrate the ground sufficiently to provide adequate support and stability for the player. When this wear occurs, the spikes must be replaced.

Spikes are generally formed with the spike portion attached to the center of one side of a circular flange. Attached to the other side of the flange is a cylindrical, exteriorly threaded post. Standard golf shoes have a sole with cylindrical, interiorly threaded recesses therein for receiving the threaded post of a golf spike. The spike assembly is attached to the sole by screwing the threaded post into the threaded recess of the sole. Standard spikes have a circular flange having several holes on opposite sides of the conical spike portion capable of receiving the ends of a wrench or other tool used to tighten or loosen the spike assembly within the recess in the sole, for the purposes of installation and removal. Frequently, after the spikes have been installed and the golf shoes worn for a period of time, these spikes become very difficult or impossible to remove. The holes in the flange for accepting a spike wrench become clogged within dirt and debris, making use of such a tool difficult, if not impossible. Moisture and debris often work their way under the flange and contact the threads of the post and/or recess, thus preventing, or creating extreme difficulty in the removal and replacement of old, worn spikes. Thus, the necessity for a replacement spike assembly adapted for attachment over an old, worn spike that cannot be removed from the sole of the shoe on which it is installed is evident, but no such device has heretofore been developed.

DESCRIPTION OF THE PRIOR ART

Applicant is aware of the following U.S. Patents relating to replaceable cleats for shoes.

| U.S. Pat. No. | Issued | Inventor | Title |
|---|---|---|---|
| 3,020,654 | 02-13-1962 | McCann | AUXILIARY SOLE FOR SPORT SHOES |
| 3,331,148 | 07-18-1967 | Hollister et al. | CLEAT MEANS FOR ATHLETIC SHOES |
| 3,423,855 | 01-28-1969 | Kosono | SPIKE FOR SHOES |
| 4,240,215 | 12-23-1980 | Broussard | SHOE SPIKE |

-continued

| U.S. Pat. No. | Issued | Inventor | Title |
|---|---|---|---|
| 4,445,288 | 05-01-1984 | Frör | SPORT SHOE WITH A STUDDED SOLE |
| 4,644,672 | 02-24-1987 | Dassler et al. | OUTER SOLE FOR AN ATHLETIC SHOE HAVING CLEATS WITH EXCHANGEABLE GRIPPING ELEMENTS |
| 4,723,366 | 02-09-1988 | Hagger | TRACTION CLEAT WITH REINFORCED RADIAL SUPPORT |

McCann U.S. Pat. No. 3,020,654 discloses an auxiliary sole which acts as a covering for the sole of a golf shoe having spikes. The auxiliary sole has hollow disc shaped projections for mating with the spikes of standard golf shoes. The projections are magnetized to effect the attachment of the spikes to the projections.

Hollister et al. U.S. Pat. No. 3,331,148 teaches a cleat means for athletic shoes. The cleat is hollow, with a narrow socket extending inwardly from its base. The cleat socket is placed over a metal attaching post, attached to the shoe sole, having an unequal diameter along its length, thereby forming a ridge or shoulder. When the cleat is forced over the attaching post, the ridge on the post is forced into the cleat material thereby anchoring the cleat to the post.

Kosono U.S. Pat. No. 3,423,855 discloses a spike for golf shoes formed of a single metal plate. A flange is formed from a metal plate. A hollow pin is centrally formed by a press operation on the flange. A screw member for attachment to the sole of a golf shoe is formed by cutting two tabs on the flange on opposing sides of the pin. These tabs are then bent upwardly in a direction opposite to that of the pin and formed into a cylindrical shape. Male threads are then formed on the exterior of the screw member.

Broussard U.S. Pat. No. 4,240,215 shows a shoe spike assembly that is self-cleaning to prevent dirt buildup around its base. A movable washer, made of a material with non-wetting properties such as Teflon, is placed into a wide groove near the base of the spike. During engagement with the ground, the washer, with a width thinner than that of the groove, changes in orientation thereby causing movement of soil and other debris thus preventing accumulation and compaction around the spike.

Frör U.S. Pat. No. 4,445,288 teaches a sports shoe having a sole with small pockets. Within each pocket is a projecting horn. A cleat with a hollow space extending inwardly from its base is placed over the horn and secured to the sole with a locking washer placed over the cleat within the pocket. The locking washer is secured within the pocket by engaging grooves formed in the pocket sidewalls.

Dassler et al. U.S. Pat. No. 4,644,672 shows a sole with raised areas, within which is a recessed area. A grooved stud with a flange is molded within the recessed area. A cleat with a hollow interior is forced over the stud and thereby attached to the sole.

Hagger U.S. Pat. No. 4,723,366 discloses a cleat with a reinforced support. The cleat includes a stem and a threaded head portion with a flange therebetween. A slightly domed, synthetic skirt is molded directly upon the flange for reinforced support of the cleat.

SUMMARY OF THE INVENTION

The present invention is a replacement golf spike for attachment to the nub of an old, worn golf spike. The replacement spike allows the attachment of a new spike assembly directly to an old spike that is impossible, or very difficult, to remove from the sole of the shoe to which it is attached, thereby obviating the need for removing the old spike from the sole of the shoe. The invention includes a generally hollow, conical spike member connected at its base to a flange. The flange is dish-shaped and extends radially outwardly from the base of the spike member. The hollow interior portion of the spike member is of sufficient dimension to allow placement thereof over the nub of an old, worn spike. The hollow spike member and flange are held in place over the nub and flange of the worn spike by epoxy or other suitable adhesive means.

OBJECTS OF THE INVENTION

The principal object of the present invention is to provide a replacement cleat or spike for the sole of a shoe.

Another object of the invention is to provide a replacement spike for the sole of a golf shoe for attachment over the nub of an old, worn spike.

Another object of the invention is to provide a replacement spike for attachment over an old, worn spike that cannot be removed from the sole of the shoe to which it is attached.

A further object of this invention is to provide a replacement spike for old, worn spikes that can be used without removing the worn spikes from the sole of a golf shoe.

A still further object of this invention is to provide a replacement spike for golf shoes that requires no special tools for the attachment thereof.

BRIEF DESCRIPTION OF THE DRAWINGS

The foregoing and other objects will become more readily apparent by referring to the following detailed description and the appended drawings in which:

FIG. 1 is a cross-sectional view of the invented replacement spike attached to an old, worn spike attached to the sole of a golf shoe.

FIG. 2 is an isometric view of the invented replacement spike.

FIG. 3 is a top view of the replacement spike.

FIG. 4 is a side view of the replacement spike.

DETAILED DESCRIPTION

Referring now to FIGS. 1 through 4, the invented replacement spike assembly 10 has a downwardly tapered spike member 12 having a wide base 22 and a narrow tip 24. At least a portion of the spike member 12 is hollow, defining a cavity 14 bounded by the inner wall 28 of the spike 12. The spike member is attached at its base to the central portion of a circular flange 16. The flange is concentric with, and extends radially outwardly from, the base of the spike member 12. The flange is dish-shaped, with the lower surface 18 of the flange 16 being slightly convex and the upper surface 20 being slightly concave. The cavity 14 within the spike member 12 is not enclosed by the flange 16 extending from its base 22, thus one end of the cavity is exposed.

In operation, as shown in FIG. 1, the invented spike assembly 10 is placed over an old, worn spike attached to the sole of a golf shoe by the standard means of a threaded post screwed into an interiorly threaded mounting receptacle within the sole. The cavity 14 and the upper concave surface 20 of the flange 16 are coated with epoxy or other suitable adhesive. The spike structure 10 is then placed over the worn spike so that the exposed end of the cavity 14 at the base 22 of the spike member 12 is placed over the worn nub of an old spike, with the flange 16 being situated over the flange of the old spike attached to the sole of the golf shoe. The concave upper surface 20 of flange 16 generally conforms to the convex shape of the ground-engaging surface of the flange of the worn spike. The adhesive bonds the upper surface of flange 16 to the flange of the worn spike as well as the inner wall 28 of the spike member 12 to the nub of the worn spike, if sufficient length of the worn spike remains.

ALTERNATIVE EMBODIMENTS

The invention can also be adapted to provide replacement spikes or cleats for other types of athletic shoes, such as football and baseball shoes, or any sole that utilizes cleats or projections for penetration and grasping of the walking surface.

SUMMARY OF THE ACHIEVEMENT OF THE OBJECTS OF THE INVENTION

From the foregoing, it is readily apparent that I have invented a replacement cleat or spike for the sole of a shoe, particularly for the sole of a golf shoe, that is attached to the nub of an old, worn spike, without requiring the removal of the worn spike from the sole of the golf shoe, and which requires no special tools for the attachment thereof.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A spike structure for attachment to the outer, earth-engaging surface of a worn spike on the sole of a shoe, comprising:
   - a spike member having a base and a tip;
   - a flange having a upper surface and a lower surface depending from and extending outwardly from, said base of said spike member;
   - a cavity in the spike structure adapted for receiving the nub of the worn spike; and
   - means for permanently attaching the spike structure to the worn spike, said means for permanently attaching being an adhesive positioned on an inner portion of the cavity and flange so as to create a bond between the spike structure and the worn spike.

2. The spike structure of claim 1 wherein said spike member is tapered.

3. The spike structure of claim 1 wherein said spike member is generally conically shaped.

4. The spike structure of claim 1 wherein said spike member is generally frusto-conically shaped.

5. The spike structure of claim 1 wherein the outer edge of said flange is generally circularly shaped.

6. The spike structure of claim 1 wherein said lower surface of said flange being slightly convex and said upper surface of said flange being slightly concave.

7. The spike structure of claim 1 wherein said cavity is tapered.

8. The spike structure of claim 1 wherein said spike member is centrally attached to said flange.

9. The spike structure of claim 1 wherein said spike member and said flange are made of metal.

10. The spike structure of claim 1 wherein said flange is made of plastic.

11. A method for placing spikes on the outer, earth-engaging surface a worn spike on the sole of a shoe, comprising the steps of:

forming a spike structure comprising:

a spike member having a base and a tip;

a flange, having an upper surface and a lower surface, depending from, and extending outwardly from, the base of the spike member;

providing a cavity in the spike structure adapted for receiving the nub of the worn spike; and fixing the spike structure over the worn spike by forming a permanent bond between the spike structure and the worn spike by applying an adhesive between the spike structure and the worn spike.

12. The method of claim 11 wherein the spike member is at least partially hollow, thereby defining at least a portion of the cavity.

13. The method of claim 11 wherein the spike member is tapered.

14. The method of claim 11 wherein the spike member is generally conically shaped.

15. The method of claim 11 wherein the spike member is generally frusto-conically shaped.

16. The method of claim 11 wherein the outer edge of the flange is generally circularly shaped.

17. The method of claim 11 wherein the lower surface of the flange is slightly convex and the upper surface of the flange is slightly concave.

18. The method of claim 11 wherein the cavity is tapered.

19. The method of claim 11 wherein the spike member is centrally attached to the flange.

20. The method of claim 11 wherein the spike member and the flange are made of metal.

21. The method of claim 11 wherein the flange is made of plastic.

* * * * *